US010008781B1

(12) United States Patent
Pan et al.

(10) Patent No.: US 10,008,781 B1
(45) Date of Patent: Jun. 26, 2018

(54) LOW-PROFILE BROADBAND HIGH-GAIN FILTERING ANTENNA

(71) Applicant: SOUTH CHINA UNIVERSITY OF TECHNOLOGY, Guangdong (CN)

(72) Inventors: Yongmei Pan, Guangdong (CN); Pengfei Hu, Guangdong (CN); Xiuyin Zhang, Guangdong (CN)

(73) Assignee: SOUTH CHINA UNIVERSITY OF TECHNOLOGY, Guangdong (CN)

( * ) Notice: Subject to any disclaimer, the term of this patent is extended or adjusted under 35 U.S.C. 154(b) by 0 days. days.

(21) Appl. No.: 15/554,714

(22) PCT Filed: Jan. 27, 2017

(86) PCT No.: PCT/CN2017/072786

§ 371 (c)(1),
(2) Date: Aug. 31, 2017

(87) PCT Pub. No.: WO2017/148237

PCT Pub. Date: Sep. 8, 2017

(30) Foreign Application Priority Data

Feb. 29, 2016 (CN) ..... 2016 1 0116579
Jan. 6, 2017 (CN) ..... 2017 1 0009959

(51) Int. Cl.
*H01Q 1/38* (2006.01)
*H01Q 15/00* (2006.01)
(Continued)

(52) U.S. Cl.
CPC ..... *H01Q 15/0053* (2013.01); *H01Q 1/20* (2013.01); *H01Q 9/0407* (2013.01); *H01Q 13/206* (2013.01)

(58) Field of Classification Search
CPC ..... H01Q 15/0053; H01Q 13/206; H01Q 9/0407; H01Q 1/20; H01Q 1/38
See application file for complete search history.

(56) References Cited

U.S. PATENT DOCUMENTS 5,043,738 A * 8/1991 Shapiro ..... H01Q 21/065 343/700 MS
2008/0079644 A1 4/2008 Cheng
2013/0063310 A1* 3/2013 Mak ..... H01Q 1/246 343/700 MS

FOREIGN PATENT DOCUMENTS

CN 101038983 9/2007
CN 102820513 12/2012
(Continued)

*Primary Examiner* — Hoang Nguyen
(74) *Attorney, Agent, or Firm* — JCIPRNET

(57) ABSTRACT

The present invention discloses a low-profile broadband high-gain filtering antenna. The antenna comprises a radiator, an upper-layer dielectric substrate, a lower-layer dielectric substrate, a microstrip feed-line having open stubs, a ground plane having a plurality of spaced slots, and a metallized via. The radiator generates resonances, provides a broadband and high-gain radiation passband, and meanwhile, adjusting the dimensions of the radiator can adjust the roll-off rate at the upper edge of the passband. The open stub generates a radiation null, and suppresses a resonance in upper band of the antenna. The spaced slot suppresses a resonance in lower band of the antenna. The metallized via connects the microstrip feed-line and the ground plane, generates a radiation null, and improves the roll-off rate at the lower edge of the passband.

10 Claims, 9 Drawing Sheets

(51) Int. Cl.

| | |
|---|---|
| ***H01Q 13/20*** | (2006.01) |
| ***H01Q 1/20*** | (2006.01) |
| ***H01Q 9/04*** | (2006.01) |

(56) References Cited

FOREIGN PATENT DOCUMENTS

| | | |
|---|---|---|
| CN | 103219593 | 7/2013 |
| CN | 104241840 | 12/2014 |
| CN | 105591197 | 5/2016 |
| CN | 205406719 | 7/2016 |

* cited by examiner ($\phi = 90°$)

($\phi = 0°$)

LOW-PROFILE BROADBAND HIGH-GAIN FILTERING ANTENNA

CROSS-REFERENCE TO RELATED APPLICATION

This application is a 371 application of the International PCT application serial no. PCT/CN2017/072786, filed on Jan. 27, 2017, which claims the priority benefit of China application no. 201610016579.7, filed on Feb. 29, 2016 and China application no. 201710009959.5, filed on Jan. 6, 2017. The entirety of each of the above-mentioned patent applications is hereby incorporated by reference herein and made a part of this specification.

TECHNICAL FIELD

The present invention relates to the field of wireless communication antenna, and in particular, to a low-profile broadband high-gain filtering antenna.

BACKGROUND

In wireless communication system, multifunctional circuit module is widely concerned because of its advantages such as small size and good overall performance. Antenna and filter are two indispensable elements at radio frequency front end. Generally, the antenna and the filter are individually designed as two elements, and then these two elements are matched to 50 ohm standard ports respectively, and subsequently cascaded. As such, the size of the entire module is increased, which is unfavorable to the radio frequency front end with a limited space. Since bandwidths of the filter and the antenna are not completely consistent, resulting in that the filtering performance is affected. To overcome these problems, a module where both the filter and the antenna are integrated is provided.

At present, most solutions of integrating filter and antenna choose co-design. In these solutions, the antenna and the filter are directly connected, and do not need to be matched to the 50 ohm standard port. Co-design reduces the size of the module and prevents loss caused by matching to the standard port. Although the co-design of the filter and the antenna improves the performance of the module to some extent, the loss of the filter is inevitable, especially in broadband design when a multi-order resonator is desired, the loss is more severe, and the antenna gain is relatively low.

Currently, few antenna designs can achieve good filtering performance and harmonic suppression function without using a complicated filtering circuit.

SUMMARY OF THE INVENTION

The present invention overcomes the above defects existing in the prior art, and to provide a low-profile broadband high-gain filtering antenna.

The present invention is realized at least via one of the following technical solutions.

A low-profile broadband high-gain filtering antenna includes a radiator, an upper-layer dielectric substrate, a lower-layer dielectric substrate, a microstrip feed-line having open stubs, a ground plane having a plurality of spaced slots, and a metallized via; the radiator is disposed at an upper surface of the upper-layer dielectric substrate, the microstrip feed-line is disposed at a lower surface of the lower-layer dielectric substrate, and the ground plane is disposed between the upper-layer dielectric substrate and the lower-layer dielectric substrate; the radiator generates resonances and provides a broadband and high-gain radiation passband, and meanwhile, adjusting dimensions of the radiator can control the roll-off rate at an upper edge of the passband; the open stub generates a radiation null, and suppresses a resonance of the antenna in upper band; the spaced slots suppresses a resonance of the antenna in lower band; and the metallized via connects the microstrip feed-line and the ground plane, generates a radiation null, and improves the roll-off rate at a lower edge of the passband.

Further, the spaced slots are a plurality of segments of slots arranged on the ground plane in a manner of their short-sides close to each other.

Further, the shape of the slot is a rectangle, a butterfly, an ellipse, or an equivalent variation thereof.

Further, the metallized via is solid or hollow, and one or more metallized vias may be provided; and the radiator is a metallic patch or a dielectric block.

Further, the radiator is one unit or an array configuration of a plurality of units.

Further, when the radiator is a plurality of units, sizes of the units may be the same or different.

Further, when the radiator is a plurality of units, a direction parallel to a length direction of the microstrip feed-line is along a direction of y axis, and the radiator comprises three or more than three units in the direction of y axis, wherein the size of the unit (1*b*) located at an outer side is greater than that of the unit (1*a*) located at an inner side in the direction of y axis.

Further, when the unit of the radiator is the metallic patch, its shape is a rectangle, a circle, an ellipse, an annular, or an equivalent variation thereof; and when the radiator is the dielectric block, its shape is a cuboid, a circular cylinder, a semi-circular cylinder, or an equivalent variation thereof.

Further, the open stub extends out from the microstrip feed-line, and the open stub is a pair of or a plurality of pairs of stubs symmetrically distributed on both sides of the microstrip feed-line, the plurality of pairs of stubs being in a spaced distribution, each pair of stubs having a different length between an initial end and a terminal end, the length $l_p$ of each stub satisfying $\lambda_g/5<l_p<\lambda_g/3$, $\lambda_g$ denoting a waveguide wavelength corresponding to a frequency of the radiation null generated by the stub.

Furthermore, the shape of the open stub is a rectangle, a T shape, a butterfly, or an equivalent variation thereof.

Compared with the prior art, the present invention achieves the following beneficial effects:

1. Various types of radiators may be used in the design of the filtering antenna. For example, when the radiator is a dielectric unit, 10 dB impedance bandwidth of the antenna reaches 61%, the average gain is 8.7 dBi, out-of-band suppression surpasses 23 dB, and different bandwidths (16%-61%) can be obtained by changing the dimensions of the antenna, and meanwhile, the good filtering performance is maintained; and when the radiator is a metallic patch having a plurality of units, 10 dB impedance bandwidth may reach 28.4%, the average gain is 8.2 dBi, and out-of-band suppression surpasses 22 dB.

2. A resonance in lower band is removed by modifying the slot, and a metallized via and open stubs are introduced to generate the radiation nulls (when the radiator is an array of a plurality of units, the combination of nonuniform units improves the roll-off rate at the upper edge of the passband), thus the filtering performance is integrated into the design of the antenna; and meanwhile, no complicated filtering circuit is involved, the loss of the antenna is low, and the efficiency is high.

3. The filtering antenna has the characteristics of low profile, broad bandwidth and high gain, and meanwhile has a wide stopband, which may implement harmonic suppression; and the antenna has a compact structure, and is easy to be manufactured and assembled.

DETAILED DESCRIPTION OF THE EMBODIMENT

The present invention is further described with reference to the accompanying drawings and specific embodiments.

Embodiment 1

Figure 1:
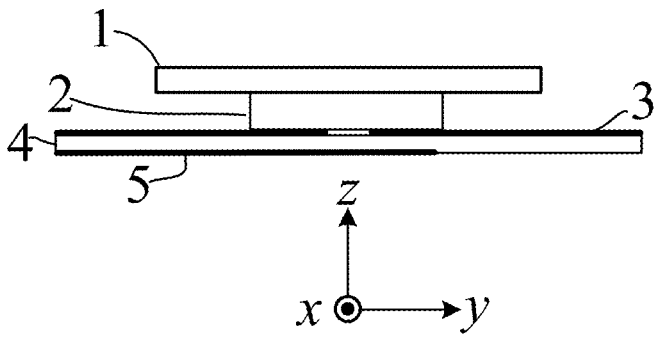
FIG. 1 is a side view of Embodiment 1 of the present invention.
Figure 2:
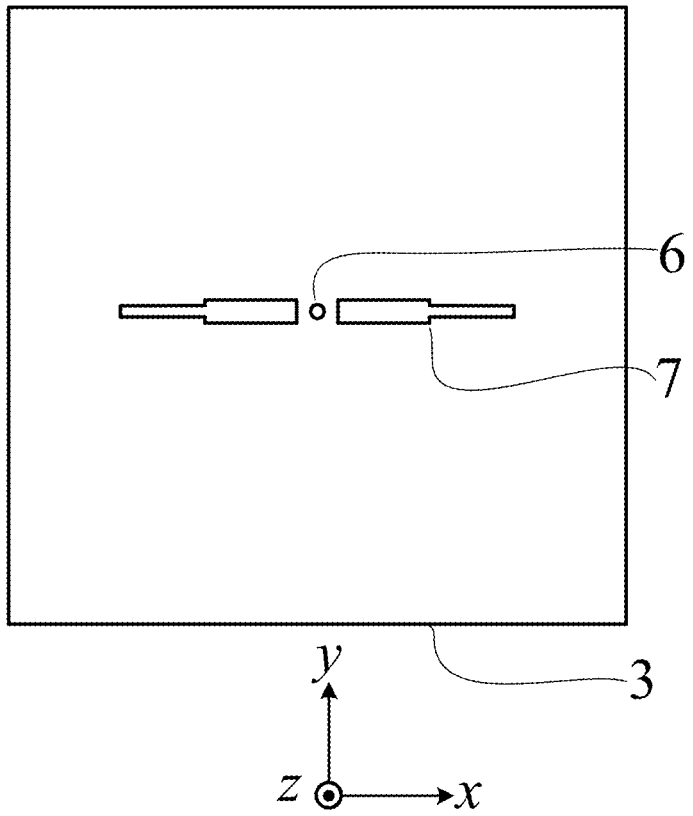
FIG. 2 is a top view of the ground plane according to Embodiment 1 of the present invention.
Figure 3:
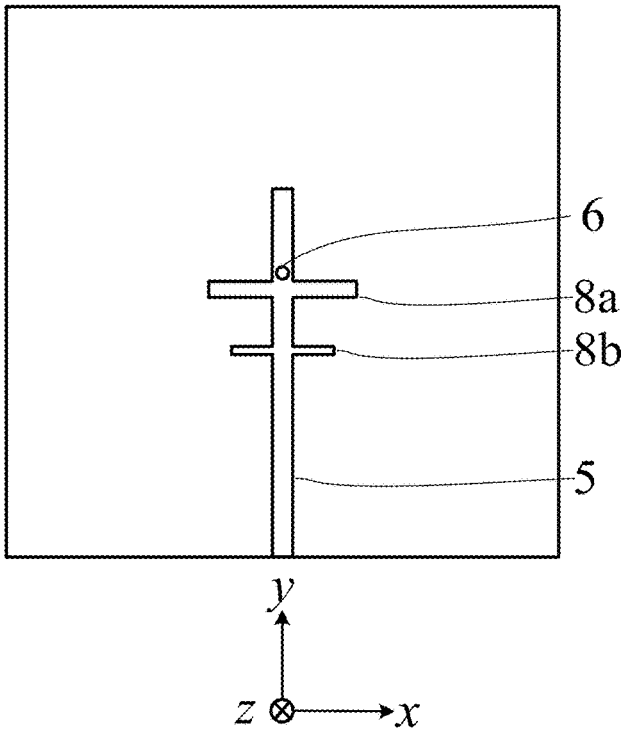
FIG. 3 is a bottom view of the feeding circuit according to Embodiment 1 of the present invention.

Referring to FIGS. 1 to 3, a low-profile broadband high-gain filtering antenna according to the present invention comprises: a radiator 1, an upper-layer dielectric substrate 2 supporting the radiator 1, a lower-layer dielectric substrate 4, a ground plane 3 disposed between the upper-layer dielectric substrate 2 and the lower-layer dielectric substrate 4, a microstrip feed-line 5 disposed at the lower surface of the lower-layer dielectric substrate 4, a metallized via 6 connecting the microstrip feed-line 5 to the ground plane 3 , spaced slots 7 on the ground plane3, and open stubs 8*a* and 8*b*extending out from the microstrip feed-line 5. In this embodiment, the radiator 1 is one unit, and the unit adopts a dielectric material, that is a cylindrical dielectric block having a height of 1.8 mm, a radius of 23.5 mm and a dielectric constant of 15. The upper-layer dielectric substrate 2 is also cylindrical, which adopts reduced size to adjust matching. The cylindrical dielectric block radiator is located at the center of the cylindrical upper-layer dielectric substrate. Referring to FIGS. 2 and 3, a microstrip-coupled slot is used to excite the antenna in this embodiment, and two segments of spaced slots 7 are disposed at the center of the ground plane 3. The space of the slots 7 is adjustable, and the spaced slot 7 suppresses a resonance in lower band. The total length of two portions of the slots 7 is about a half wavelength of the operating frequency, and the length of the slot 7 is affected by the dielectric constants of the upper dielectric substrate 2 and the lower-layer dielectric substrate 4. The impedance matching is optimized by adjusting the length of the slot 7, and a better impedance matching is obtained when the slot 7 is in a stepped structure. Referring to FIG. 3, there is a metallized via 6 between the microstrip feed-line 5 and the ground plane 3, which can generate a radiation null. The frequency of the radiation null may be adjusted by tunning the position of the metallized via 6, and the roll-off rate at the lower edge of the passband is improved. The open stubs 8*a* and 8*b*extend out from both sides of the microstrip feed-line 5, and the open stubs 8*a*, 8*b* are symmetrical to the microstrip feed-line 5, which prevents the increase of cross-polarization. In this embodiment, two pairs of the open stubs 8*a* and 8*b* are utilized, and the lengths of each of the stubs are 4.95 mm and 3.5 mm, respectively. The open stub 8*a* generates a radiation null at the upper edge of the passband and improves the roll-off rate at the upper edge of the passband. The open stub 8*b* generates a radiation null and suppresses a harmonic. The length of the open stub is about ¼ wavelength of the microstrip line at the frequency of the radiation null generated by the open stub, and a specific length of the open stub is also subject to the position of the open stub. Therefore, the length $l_p$ of the stub satisfies $\lambda_g/5<l_p<\lambda_g/3$, where $\lambda_g$ denotes the waveguide wavelength at the frequency of the radiation null generated by the stub.

Figure 4:
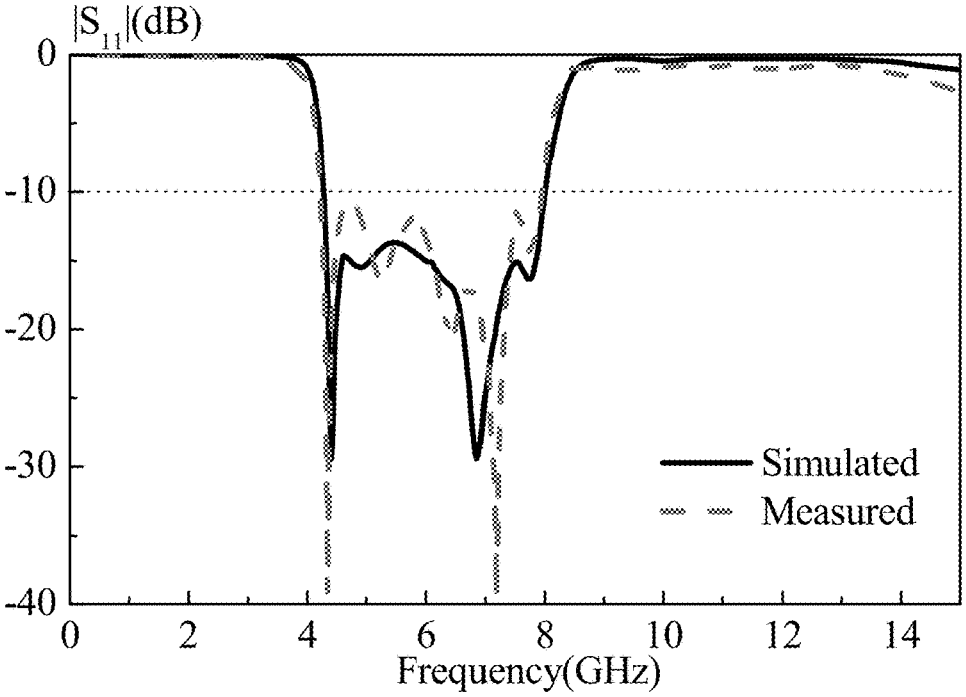
FIG. 4 is a diagram illustrating simulated and measured reflection coefficients according to Embodiment 1 of the present invention.
Figure 5:
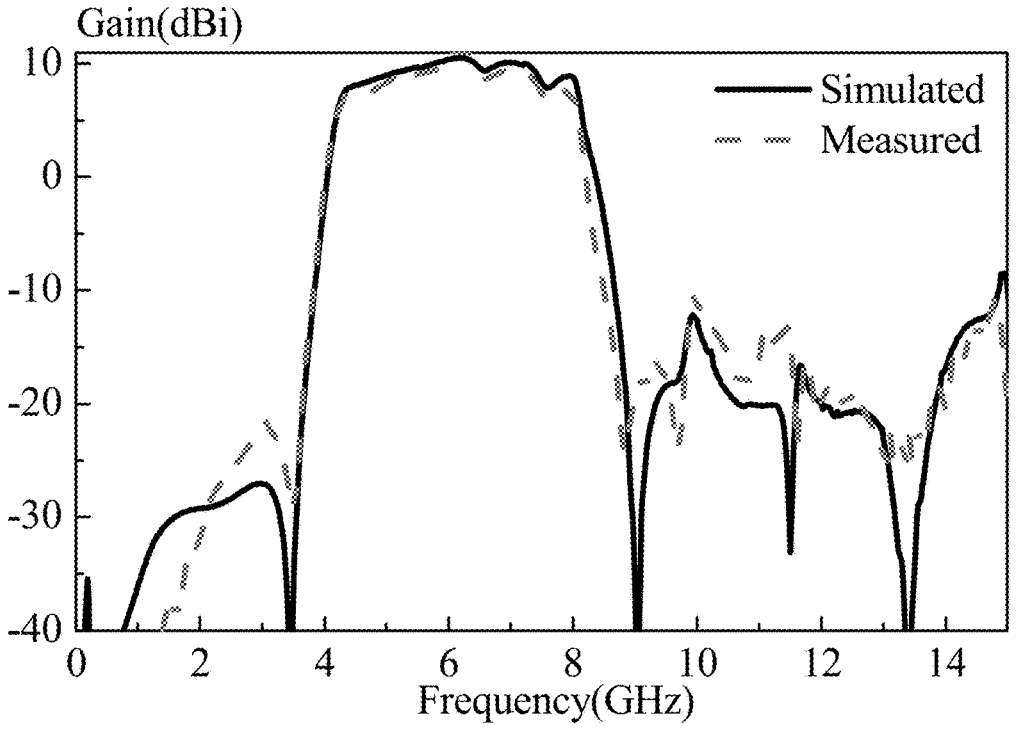
FIG. 5 is a diagram illustrating simulated and measured gain curves of the antenna according to Embodiment 1 of the present invention.
Figure 6:
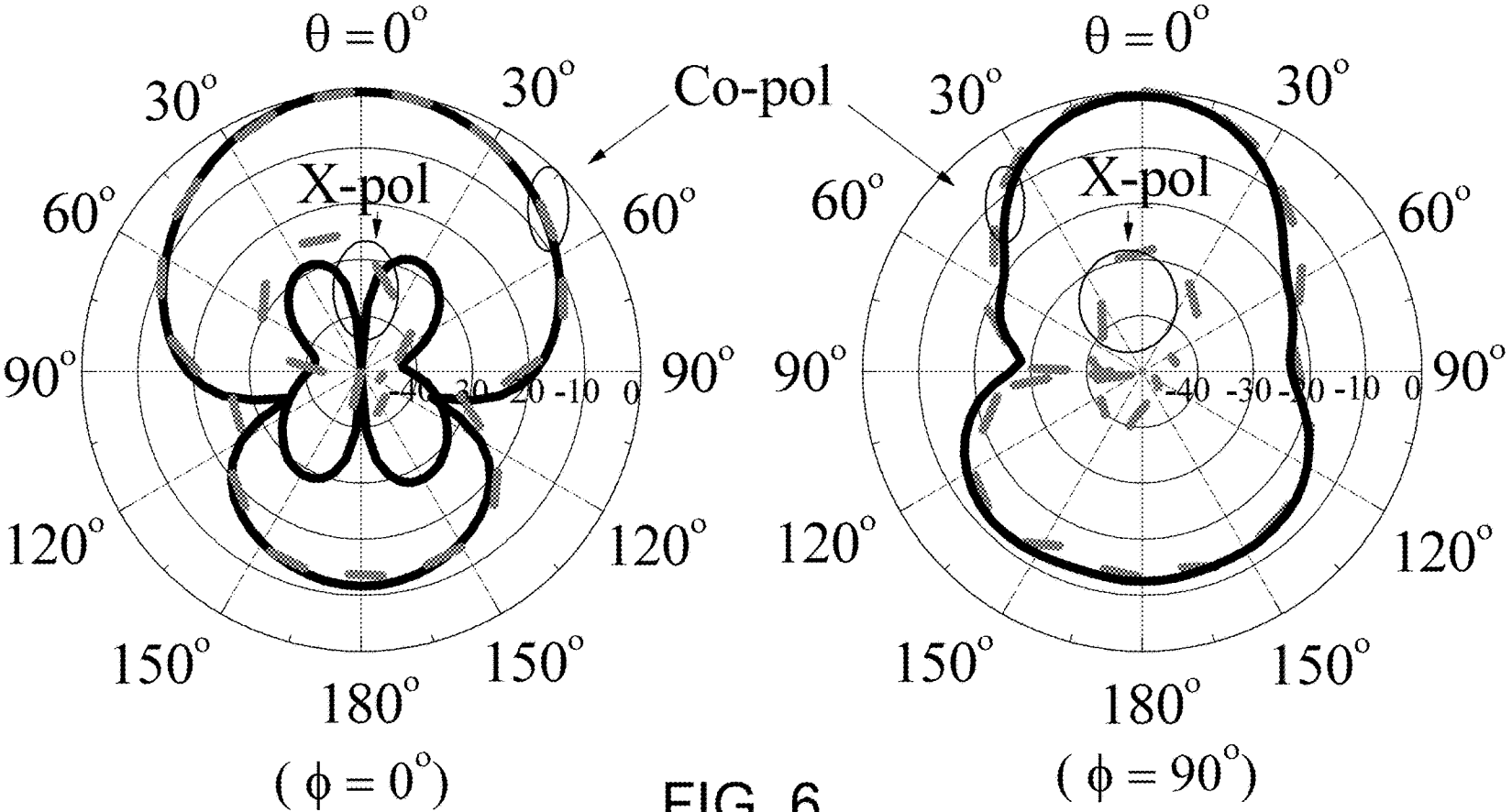
FIG. 6 illustrates normalized radiation patterns at 6.06 GHz according to Embodiment 1 of the present invention.
Figure 7:
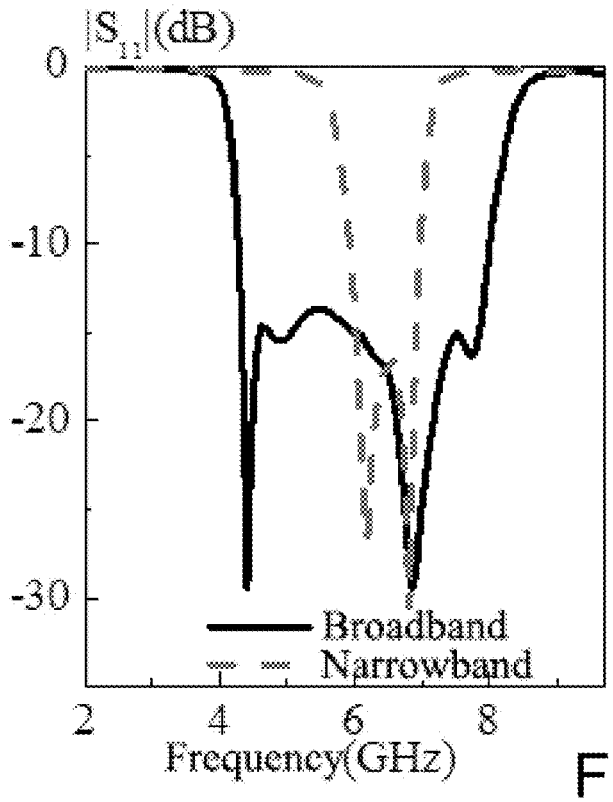
FIG. 7 is a diagram illustrating reflection coefficients of broadband and narrowband cases according to Embodiment 1 of the present invention.
Figure 8:
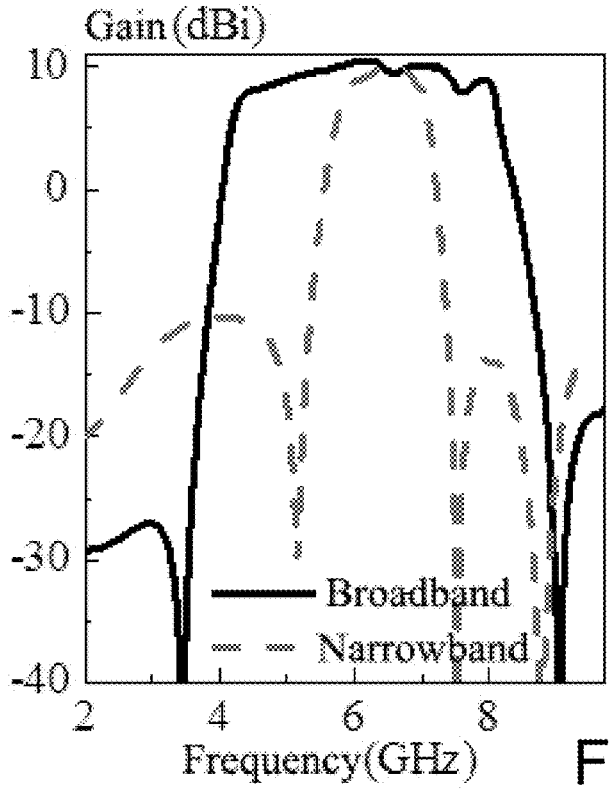
FIG. 8 is a diagram illustrating gain curves of broadband and narrowband cases according to Embodiment 1 of the present invention.
Figure 9:
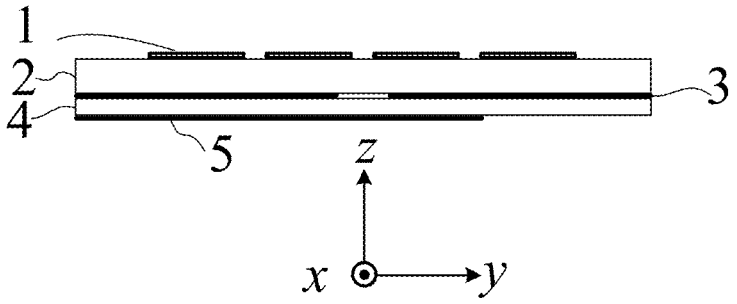
FIG. 9 is a side view of Embodiment 2 of the present invention.

Referring to FIG. 4, it illustrates simulated and measured reflection coefficients when a broadband filtering antenna is implemented in this embodiment. The measured 10 dB impedance bandwidth is 61.4% (4.22-7.96 GHz), and the stopband is very wide. In this way, a secondary harmonic is suppressed. Referring to FIG. 5, it illustrates simulated and measured antenna gains in this embodiment. The average gain is up to 8.73 dBi, a rather high roll-off rate is obtained at the edge of the passband, and the out-of-band suppression surpasses 23 dB. Referring to FIG. 6, it illustrates a normalized radiation pattern at the central frequency in this embodiment. The maximum radiation direction is right above the radiator, and the cross-polarization is low. In this embodiment, the maximum radiation direction maintains at boresight direction in the whole passband, the patterns are relatively stable, and the sidelobe of E plane is slightly increased at higher frequency band. Referring to FIGS. 7 and 8, which illustrate the reflection coefficients and antenna gains in two scenarios where narrowband (10 dB impedance bandwidth is 16%) and broadband (10 dB impedance bandwidth is 61.4%) are implemented in this embodiment. The bandwidth can be controlled by adjusting the dimensions of the antenna, and the good filtering performance can be still maintained in the case of narrowband.

Embodiment 2

Figure 10:
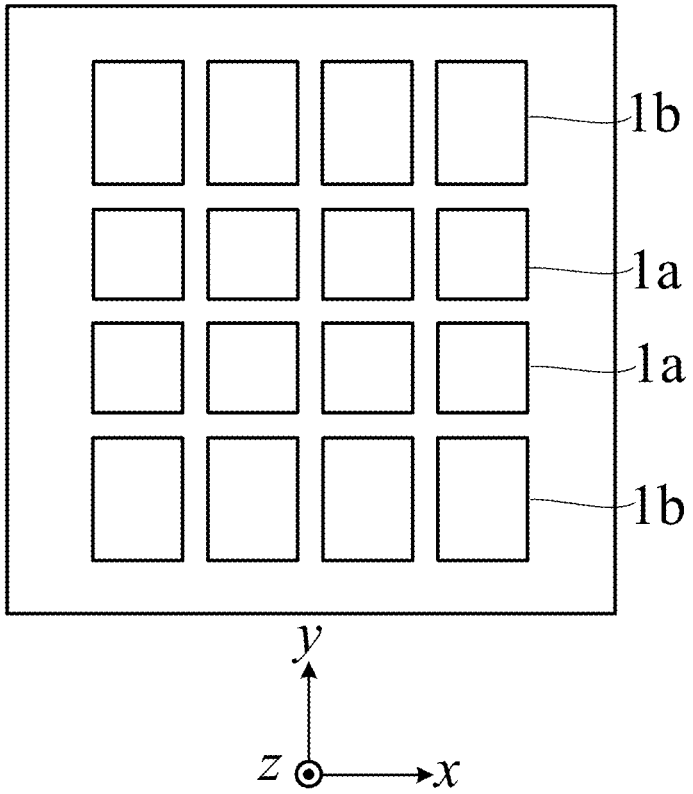
FIG. 10 is a top view of the radiator according to Embodiment 2 of the present invention.

Referring to FIGS. 9 to 12, a low-profile broadband high-gain filtering antenna according to the present invention comprises: a radiator 1, an upper-layer dielectric substrate 2 supporting the radiator 1, a lower-layer dielectric substrate 4, a ground plane 3 disposed between the upper-layer dielectric substrate 2 and the lower-layer dielectric substrate 4, a microstrip feed-line 5 disposed at the lower surface of the lower-layer dielectric substrate 4, a metallized via 6 connecting the microstrip feed-line 5 and the ground plane 3, spaced slots 7 on the ground plane 3, and open stubs 8 extending out from the microstrip feed-line 5. Referring to FIG. 10, in this embodiment, the radiator 1 is a plurality of units, and each unit is a metallic patch 1*a*, 1*b*etched on the upper-layer dielectric substrate 2, and the dimensions of the units of the radiator 1 are inconsistent. The size of the outer-side unit 1*b* is greater than that of the inner-side unit 1*a* in the direction of y axis, the length of the outer-side unit 1*b* and that of the inner-side unit 1*a* in the direction of y axis are 13.6 mm and 9.7 mm, respectively. The roll-off rate at the upper edge of the passband can be adjusted by tunning the combination of dimensions of the units. In this embodiment, 4×4 units are used, the total length of the units is about a wavelength of the microstrip line at the central frequency $\lambda_c$, the resonance frequency may be adjusted by tunning the sizes and spaces of the units, and thus the bandwidth can be controlled. The shape of the unit can be freely defined, and this embodiment uses the simplest rectangle.

Figure 11:
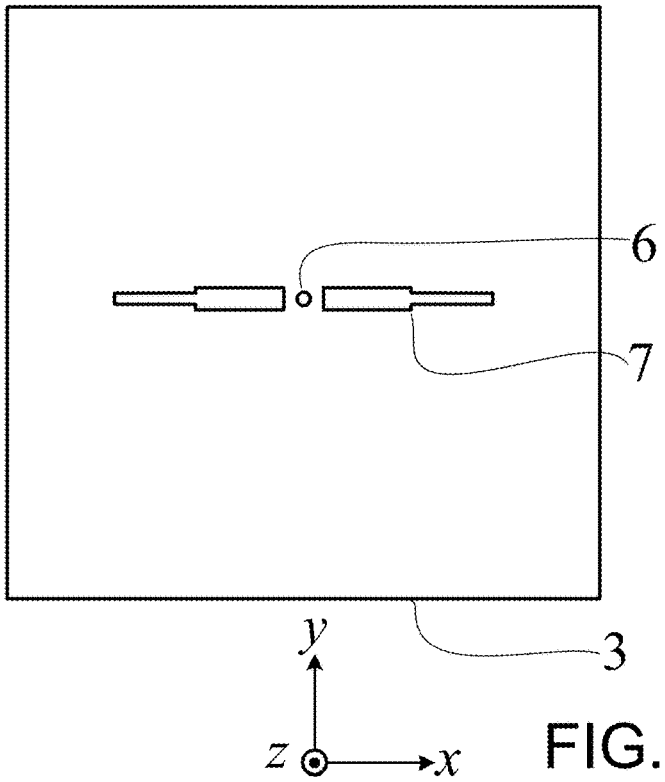
FIG. 11 is a top view of the ground plane according to Embodiment 2 of the present invention.
Figure 12:
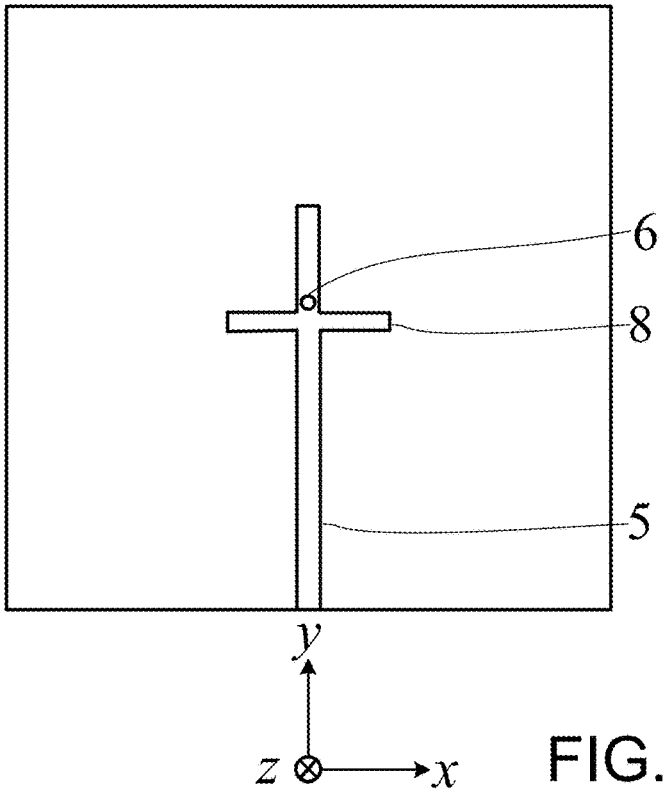
FIG. 12 is a bottom view of the feeding circuit according to Embodiment 2 of the present invention.

Referring to FIGS. 11-12, in this embodiment, the configurations of the ground plane 3, the microstrip feed-line 5, the metallized via 6, and the spaced slots 7 on the ground plane 3 are the same as those in Embodiment 1. The difference is that: referring to FIG. 12, only a pair of open stubs 8 is used in this embodiment to suppress a resonance in upper band, and the length of each stub is 5.4 mm. The roll-off rate at the upper edge of the passband is controlled by the units of the radiator 1, and the filtering performance at the upper edge of the passband and harmonic suppression can also be achieved by using a plurality of pairs of open stubs similar to Embodiment 1.

Figure 13:
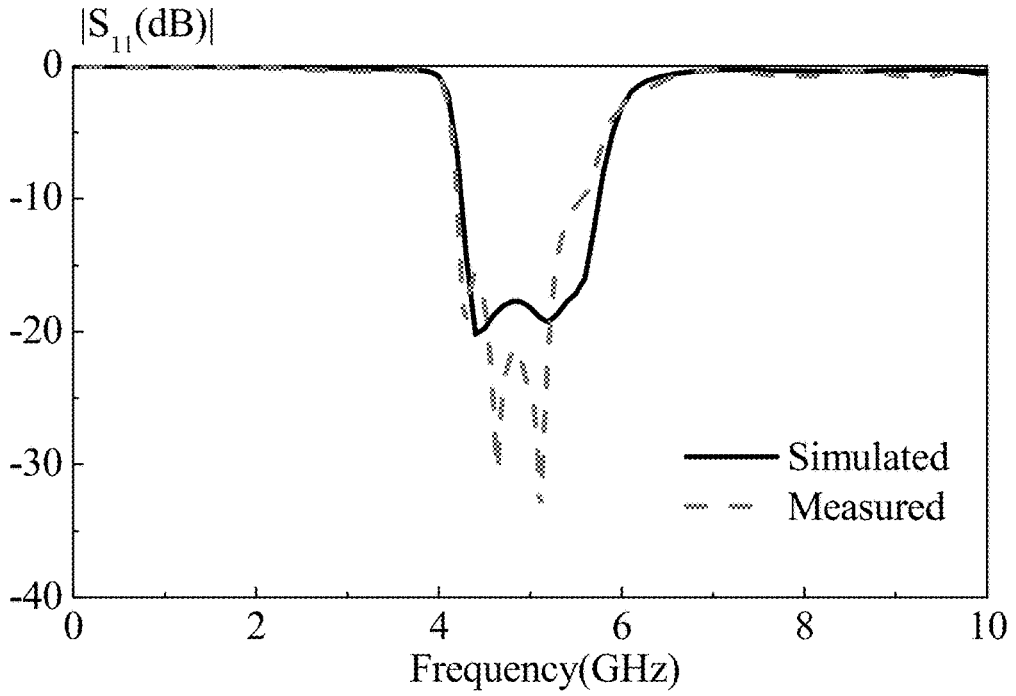
FIG. 13 is a diagram illustrating simulated and measured reflection coefficients according to Embodiment 2 of the present invention.
Figure 14:
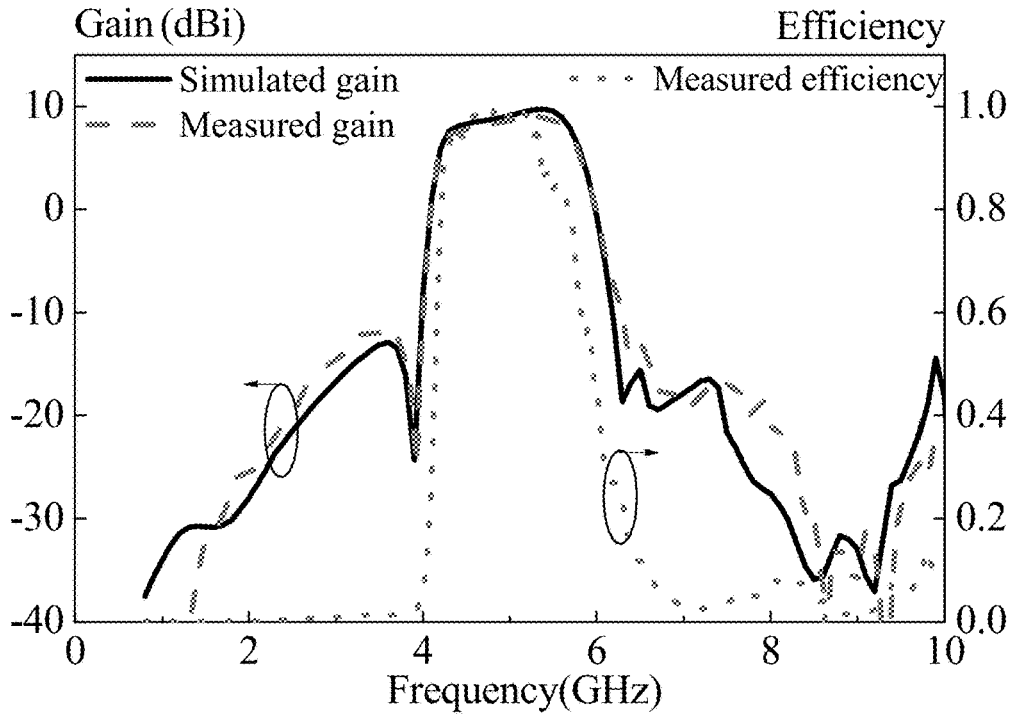
FIG. 14 is a diagram illustrating simulated and measured antenna gains according to Embodiment 2 of the present invention.
Figure 15:
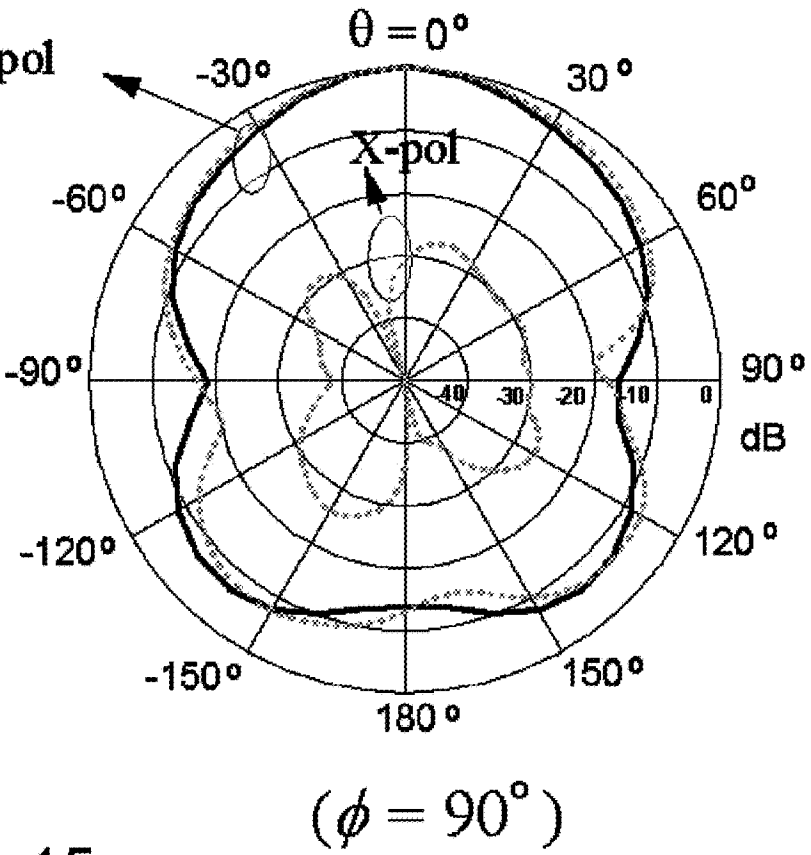
FIG. 15 illustrates normalized radiation patterns at 5 GHz according to Embodiment 2 of the present invention.
Figure 15:
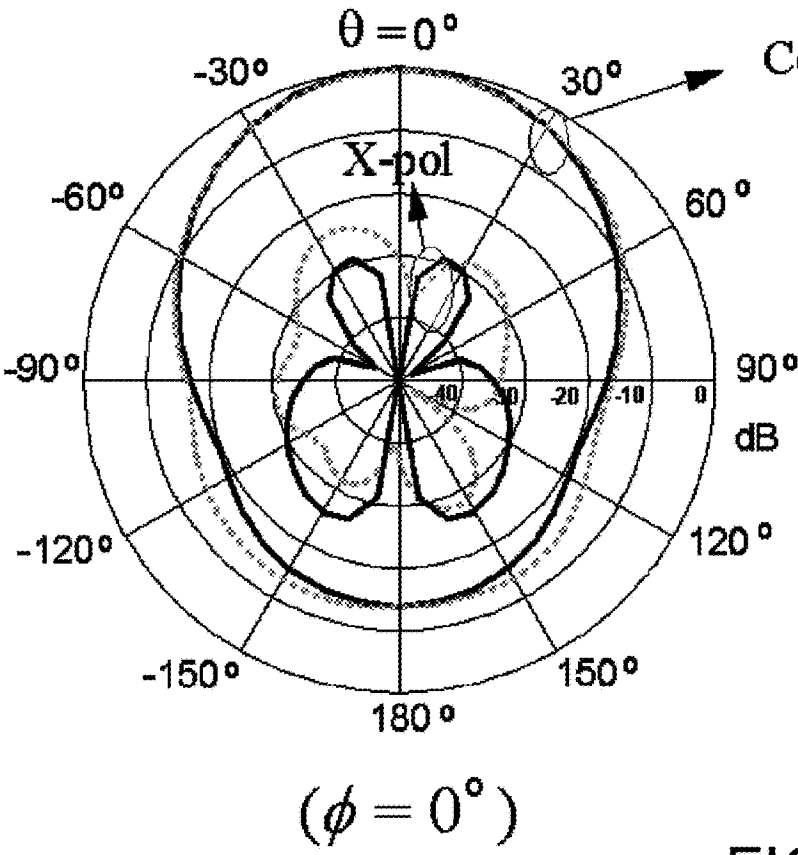

Referring to FIG. 13, it illustrates a simulated and measured $|S_{11}|$ parameter in this embodiment. The measured 10 dB impedance bandwidth is 28.4%, and the stopband $|S_{11}|$ is close to 0. In this case, the secondary harmonic is suppressed. FIG. 14 illustrates simulated and measured gains in this embodiment. The measured average gain in the passband is 8.2 dBi, a rather high roll-off rate is obtained at the edge of the passband, the out-of-band suppression surpasses 22 dB, and the efficiency in band is up to 95%. Referring to FIG. 15, it illustrates normalized radiation patterns at the central frequency of 5 GHz in this embodiment. The maximum radiation direction is right above the radiator, the co-polarization is greater than the cross-polarization by more than 25 dB, and the pattern in the whole passband is stable.

The above-described embodiments are merely two designs of the present invention and for illustration purpose only, which are not intended to limit the technical solutions of the present invention. Any modification or replacement, simplification, improvement and the like, made without departing from the spirit and principle of the present invention, shall fall within the scope of claims of the present invention.

What is claimed is:

1. A low-profile broadband high-gain filtering antenna, comprising a radiator, an upper-layer dielectric substrate, a lower-layer dielectric substrate, a microstrip feed-line having open stubs, a ground plane having a plurality of spaced slots, and a metallized via; the radiator is disposed at an upper surface of the upper-layer dielectric substrate, the microstrip feed-line is disposed at a lower surface of the lower-layer dielectric substrate, and the ground plane is disposed between the upper-layer dielectric substrate and the lower-layer dielectric substrate; the radiator generates resonances and provides a broadband and high-gain radiation passband, and meanwhile, adjusting dimensions of the radiator controls the roll-off rate at an upper edge of the passband; the open stub generates a radiation null, and suppresses a resonance of the antenna in upper band; the spaced slots suppresses a resonance of the antenna in lower band; and the metallized via connects the microstrip feed-line and the ground plane, generates a radiation null, and improves the roll-off rate at a lower edge of the passband.

2. The low-profile broadband high-gain filtering antenna according to claim 1, wherein the spaced slots are a plurality of segments of slots arranged on the ground plane in a manner of having short-sides close to each other.

3. The low-profile broadband high-gain filtering antenna according to claim 2, wherein the shape of the slot is a rectangle, a butterfly, or an ellipse.

4. The low-profile broadband high-gain filtering antenna according to claim 3, wherein the metallized via is solid or hollow, and one or more metallized vias are provided; and the radiator is a metallic patch or a dielectric block.

5. The low-profile broadband high-gain filtering antenna according to claim 4, wherein the radiator is one unit or an array configuration of a plurality of units.

6. The low-profile broadband high-gain filtering antenna according to claim 5, wherein when the radiator is the plurality of units, each unit has a same or different size.

7. The low-profile broadband high-gain filtering antenna according to claim 5, wherein when the radiator is the plurality of units, a direction parallel to a length direction of the microstrip feed-line is along a direction of y axis, and the radiator comprises three or more than three units in the direction of y axis, wherein the size of the unit located at an outer side is greater than that of the unit located at an inner side in the direction of y axis.

8. The low-profile broadband high-gain filtering antenna according to claim 7, wherein when the unit of the radiator is the metallic patch, a shape thereof is a rectangle, a circle, an ellipse, or an annular;

and when the radiator is the dielectric block, a shape thereof is a cuboid, a circular cylinder, or a semi-circular cylinder.

9. The low-profile broadband high-gain filtering antenna according to claim 4, wherein the open stub extends out from the microstrip feed-line, and the open stub is a pair of or a plurality of pairs of stubs symmetrically distributed on both sides of the microstrip feed-line, the plurality of pairs of stubs being in a spaced distribution, each pair of stubs having a different length between an initial end and an terminal end, the length $l_p$ of each stub satisfying $\lambda_g/5<l_p<\lambda_g/3$, $\lambda_g$ denoting a waveguide wavelength corresponding to a frequency of the radiation null generated by the stub.

10. The low-profile broadband high-gain filtering antenna according to claim 9, wherein a shape of the open stub is a rectangle, a T shape, or a butterfly.

* * * * *